US006394849B2

(12) United States Patent
Kasai

(10) Patent No.: US 6,394,849 B2
(45) Date of Patent: May 28, 2002

(54) ELECTRICAL JOINT CONNECTOR

(75) Inventor: Koji Kasai, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/769,257

(22) Filed: Jan. 26, 2001

(30) Foreign Application Priority Data

Feb. 1, 2000 (JP) ..... 2000-023583

(51) Int. Cl.[7] ..... H01R 25/00
(52) U.S. Cl. ..... 439/655
(58) Field of Search ..... 439/210, 213, 439/655, 949; 361/611, 775; 174/68.2

(56) References Cited

U.S. PATENT DOCUMENTS

| | | | | |
|---|---|---|---|---|
| 2,977,672 A | | 4/1961 | Telfer | |
| 4,739,441 A | * | 4/1988 | Galletly | 361/341 |
| 4,778,393 A | | 10/1988 | Hosogai et al. | |
| 4,938,719 A | * | 7/1990 | Sawai et al. | 439/714 |
| 4,945,188 A | * | 7/1990 | Jackson | 174/16.2 |
| 5,501,605 A | | 3/1996 | Ozaki et al. | |
| 5,618,186 A | * | 4/1997 | Saka et al. | 439/76.2 |
| 5,655,933 A | | 8/1997 | Skowronski | |
| 5,723,820 A | * | 3/1998 | Whitney et al. | 174/99 |
| 5,783,779 A | * | 7/1998 | Graham et al. | 74/88 |
| 5,908,322 A | * | 6/1999 | Seki | 439/212 |

FOREIGN PATENT DOCUMENTS

| | | |
|---|---|---|
| CH | 398 734 A | 3/1996 |
| EP | 1 071 162 A | 1/2001 |

* cited by examiner

*Primary Examiner*—Brian Sircus
*Assistant Examiner*—Thanh-Tam Le
(74) *Attorney, Agent, or Firm*—Oliff & Berridge, PLC

(57) ABSTRACT

A joint connector for connection to first, second and third exterior electrical connectors, e.g. in a wire harness, has an insulation plate with parallel first bus bars on one face providing a set of first connection tabs and parallel second bus bars on a second face crossing the first bus bars. The second bus bars at opposite ends thereof constitute second and third sets of connection tabs. The first and second bus bars are electrically connected via through holes in the insulation plate to form a circuit in the joint connector. The insulation plate and bus bars are in a casing. In use the first connection tabs connect to a first exterior connector, while the sets of second and third tabs connect to respectively second and third exterior connectors. The interior circuit is such that the circuit connections from the first connection tabs to the second connector tabs and to the third connector tabs respectively are identical.

6 Claims, 8 Drawing Sheets

ELECTRICAL JOINT CONNECTOR

BACKGROUND OF THE INVENTION

1. Field of Invention

The present invention relates to an electrical joint connector suitable to be incorporated in a wire harness to be placed on a vehicle body, such as an automobile body, and to an assembly of the joint connector and exterior connectors.

2. Description of Related Art

In a wire harness to be wired in a vehicle body, if a splice treatment of the wiring cannot be made in an internal circuit of a junction box or the like, a joint connector is connected to the electrical wiring to make the splice. A joint connector 1 having the construction shown in FIG. 8 is used normally for this kind of purpose.

The joint connector 1 accommodates joint bus bars 3, each having a tab 3*a*, provided in a casing 2. Terminals connected to the ends of the wires W branching from a wire harness W/H are inserted into a mating connector 4 and locked in position, and the connector 4 is inserted into a receiving opening 1*a* of the joint connector 1 and locked thereto to connect the connector 4 to the joint connector 1. In this manner, the electrical wires W are connected at the joint connector 1. The joint connector 1 and the connector 4 connected to each other are fixed to the wire harness W/H with a tape.

The tabs 3*a* of the joint bus bars 3 are oriented in the same direction. In addition, the joint connector 1 has only one receiving opening 1*a* for the mating connector 4. Therefore, the mating connector 4 can be inserted from only one direction into the joint connector 1. For example, referring to FIG. 9, if it is necessary to connect wires of a trunk wire harness W/H-1 to a group of wires of a branch wire harness W/H-2 and a group of wires of a branch wire harness W/H-3, still only one mating connector 4 is connected to the joint connector 1, as described above. Therefore, the electric wires to be spliced are necessarily placed into one wire harness W/H and connected to the joint connector 1 as shown in FIG. 8 or two joint connectors are prepared to splice the wires. Accordingly, it is impossible to make an optimum design of the wire harness to be connected to the joint connector. Further, the position of installation of the joint connector is restricted. As such, the joint connector cannot be disposed at an optimum position in an installation space.

Furthermore, because the joint connector 4 has two superimposed rows of terminals, it is voluminous. Thus, when the joint connector is installed on the trunk wire harness, e.g. taped up with the harness, the shape of the wire harness becomes irregular. Projecting portions are liable to be caught by other component parts when installing the trunk wire harness on a vehicle body. Consequently, wiring operability is poor. For example, paths for the trunk wire harness cannot be secured or the trunk wire harness cannot be inserted through a through-hole of a body panel.

In addition, in the case where branch connectors to be connected to respective joint connectors have the same configuration, an erroneous connection may be made. To prevent such an erroneous connection, various countermeasures are made. For example, the colors of the connectors are varied. However, when the lengths of the branch wires are equal to each other, it is impossible to securely prevent the erroneous connection.

SUMMARY OF THE INVENTION

It is an object of the present invention to provide a joint connector for a wire harness, which can be connected to mating connectors in a plurality of directions, allow an optimum division of a wire harness, be of small volume and thus be installed at an optimum position in the space of a vehicle body, and reduce the occurrence of erroneous connection.

According to the invention, there is provided a joint connector for connection to first, second and third exterior electrical connectors to effect electrical connection between the first exterior connector and each of the second and third exterior connectors. The joint connector has an insulation plate having opposite first and second main faces.

A plurality of first elongate bus bars are mounted on the first main face and extend in parallel in a first direction. First end portions of the first bus bars constitute a set of first connection tabs.

A plurality of second elongate bus bars are mounted on the second main face of the insulation plate and extend parallel in a second direction crossing the first direction, so that the first and second bus bars, as seen in plan view on one of the main faces of the insulation plate, form a lattice array having intersection points of the bus bars. Second and third end portions of the second bus bars, respectively at opposite ends of the second main face, constitute respectively a set of second connection tabs and a set of third connection tabs. The first and second bus bars are electrically joined to each other at a plurality of the intersecting points through holes in the insulation plate to form a predetermined interior circuit in the joint connector.

A casing of flat shape accommodates the insulation plate and the first and second bus bars, and has first, second and third connector-receiving locations at which the exterior connectors can be fitted to make electrical connection. The first connection tabs are located in the first connector-receiving location to connect to the first exterior connector, and the sets of second and third connector tabs are located respectively in the second and third connector-receiving locations, which are on opposite sides of the casing, to connect to the second and third exterior connectors respectively.

The interior circuit is such that the circuit connections from the first connection tabs to the set of second connector tabs and the set of third connector tabs respectively are identical. This allows the second and third connectors to be interchangeably attached at the second and third connector-receiving locations, so that erroneous connection can be avoided.

Preferably the second and third connector-receiving locations have substantially identical shape and configuration but are mutually inverted with respect to the casing, while the first connector-receiving location has a substantially different shape and configuration.

The above construction allows the connector-receiving locations to be formed in different directions. For example, the first location may be on a side of the casing perpendicular to the two opposite sides of the second and third locations, so that the casing is T-shaped. Accordingly, it is unnecessary to bundle electric wires to be spliced through the joint connector into one wire harness, but it is possible to design a circuit according to a wiring configuration of the wire harness and according to where a space for the joint connector is located. Consequently, it is possible to accomplish an optimum division of the wire harness.

Preferably, the first and second bus bars are bent downward and upward respectively at their portions connected through holes in the insulation plate. Then, the apex of the bent portion of the first bus bar and that of the bent portion of the second bus bar are brought into contact in the through-hole of the insulation plate. In this state, resistance welding is carried out to connect the bus bars to each other. It is possible to weld bus bars laminated one upon another in three or more layers.

The insulation plate has the bus bars disposed on its upper and lower surfaces. Thus, it is possible to accommodate the plate in a low, flat casing. Thus, the joint connector is not voluminous. Therefore, when the joint connector is installed on the peripheral surface of the trunk electric wire of the wire harness, this portion of the wire harness does not project much, which facilitates an operation of wiring the wire harness on a vehicle body.

BRIEF DESCRIPTION OF THE DRAWINGS

An embodiment of the invention will now be described by way of non-limitative example with reference to the accompanying drawings, in which.

DETAILED DESCRIPTION OF PREFERRED EMBODIMENTS

Figure 1:
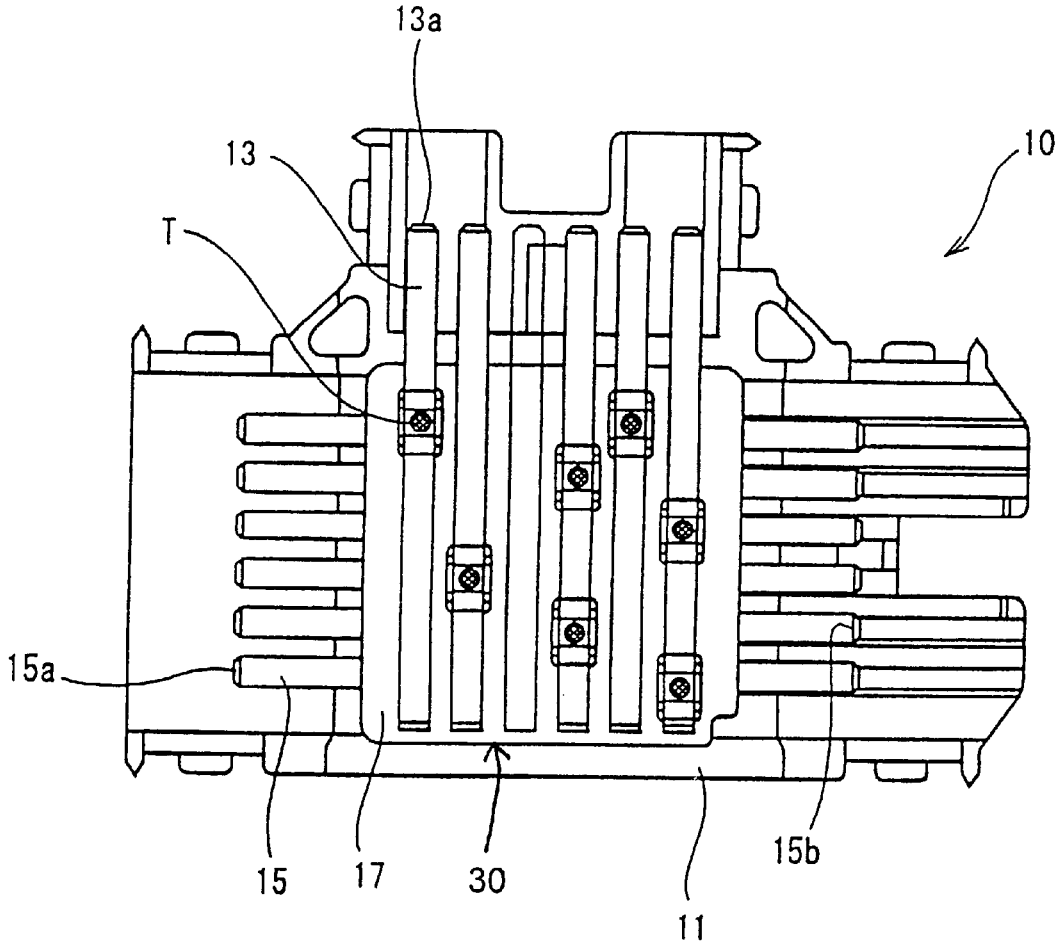
FIG. 1 is a plan view showing a joint connector which is an embodiment of the present invention, with its upper casing part removed.

FIGS. 1 to 7 show a joint connector 10 embodying the invention. As shown in FIGS. 4(A)–4(C), the joint connector 10 has a generally planar casing 20 which is relatively thin in one dimension and includes a lower casing part 11 and an upper casing part 12 and incorporates a bus bar circuit plate 30. The casing 20 is of moulded plastics material. The casing 20 has a first connector socket 22 projecting from a first edge of the outer surface of a central portion 21 which may be of approximately square shape and contains the circuit, a second connector socket 23 projecting from a second edge perpendicular to the first edge, and a third connector socket 24 projecting from a third edge perpendicular to the first edge. Thus, the casing 20 overall is approximately T-shaped.

Figure 3A:
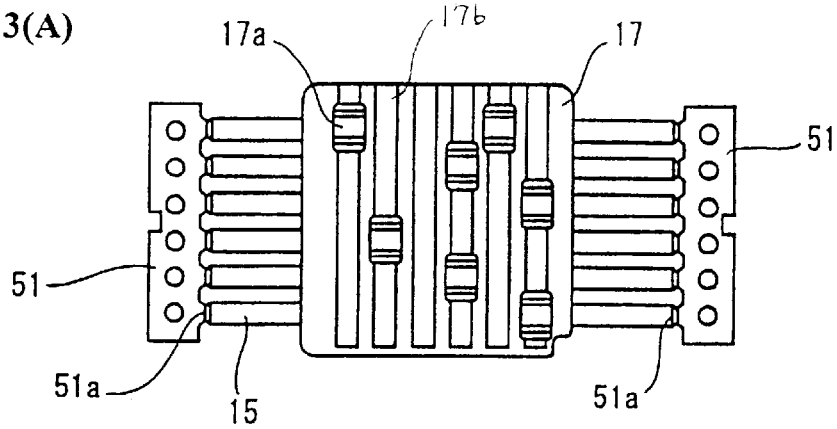
FIGS. 3(A), 3(B) and 3(C) are plan views showing the process of forming the circuit of the joint connector of FIG. 1.
Figure 3B:
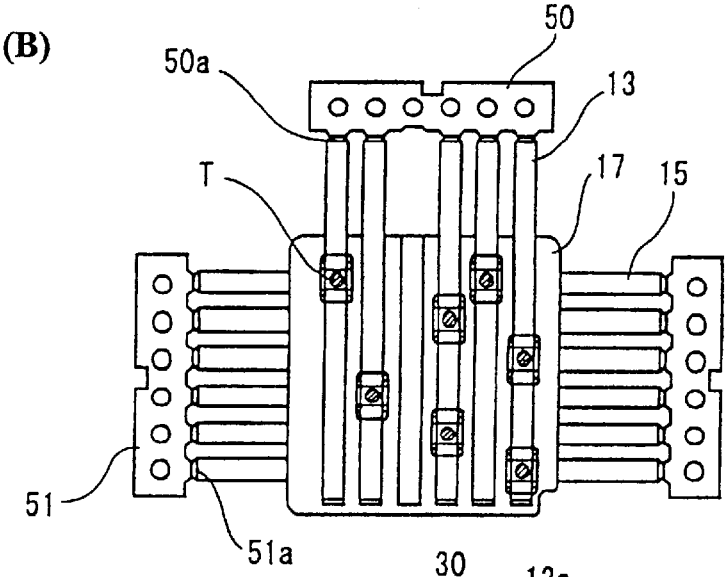
Figure 3C:
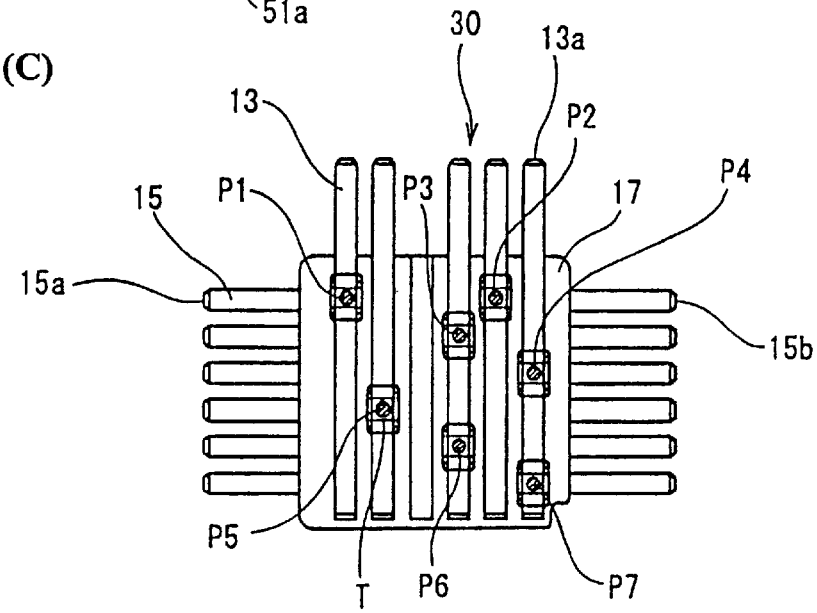

As shown in FIG. 3(C), the bus bar circuit plate 30 has an insulation plate 17 with parallel discrete elongate flat sheet metal bus bars 13 arranged on the upper surface of the insulation plate 17 extending in parallel in a first direction (Y-direction). The bus bars 13 may be spaced apart at regular intervals. Parallel discrete sheet metal bus bars 15 having the same configuration as that of the bus bars 13 are arranged on the lower surface of the insulation plate 17 extending in parallel in a second direction (X-direction) orthogonal to the first direction. The bus bars 15 may also be spaced at regular intervals. The bus bars 13 and 15 need not be equally spaced apart.

More specifically, the upper bus bars 13 extending in the Y-direction and the lower bus bars 15 extending in the X-direction may be fitted in respective grooves 17*b* (FIG. 3(A)) formed on the upper and lower surfaces of the insulation plate 17. That is, as seen in plan view, as in FIG. 3(C) for example, the bus bars 13 and 15 crossing each other form a lattice on the insulation plate 17. The bus bars 13 and 15 are connected to each other at their intersection positions P1–P7 shown in FIG. 3 (C), to form the desired internal circuit.

Figure 6:
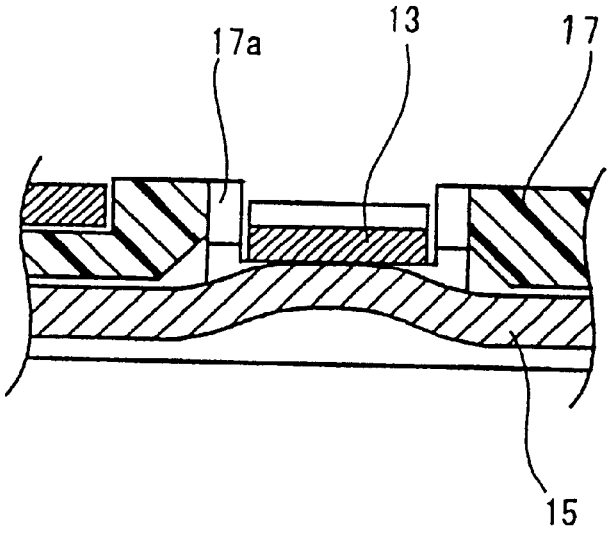
FIG. 6 is an enlarged sectional view showing a portion of upper or lower bus bars which are to be welded together in the process of making the joint connector of FIG. 1.

As shown in FIG. 6, through-holes 17*a* are formed in the insulation plate 17, at which the upper and lower bus bars 13 and 15 are bent towards each other in the shape of an approximately circular arc. The apexes of the bent portions of the bus bars are brought into contact in the through-holes 17*a*, and joined by resistance welding to form welds T (see FIGS. 3(B) and (C)). The formation of the bends in the bus bars 13 and 15 may be carried out before or after the bus bars are placed on the plate 17, preferably before.

To assemble the bus bar circuit plate 30, as shown in FIGS. 3(A)–3(C), the set of upper bus bars 13 and the set of lower bus bars 15 are arranged on the insulation plate 17, with one end of each upper bar 13 connected to a carrier 50 and both ends of each lower bar 15 connected to respective carriers 51. Resistance welding at the required positions of the upper and lower bus bars 13 and 15 is performed. Then, the carriers 50 and 51 are broken off from the bus bars 13 and 15. V-shaped grooves 50*a* and 51*a* (see FIG. 5) are formed at the connection of the bus bars 13 and 15 to the carriers 50 and 51 so that an operator can break off the carriers 50 and 51 from the bus bars 13 and 15 by folding at the grooves 50*a* and 51*a* once or twice. After removal of the carriers 50 and 51 the bus bars are held in place by their resistance welding connections.

One end of each bus bar 13 forms a tab 13*a*. The opposite ends of each bus bar 15 form tabs 15*a* and 15*b*. The tabs 13*a* project in the Y-direction into the first connector socket 22 (see FIG. 4(A)). The tabs 15*a* project in the X-direction into the second connector socket 23, while the tabs 15*b* project into the third connector socket part 24.

Figure 2:
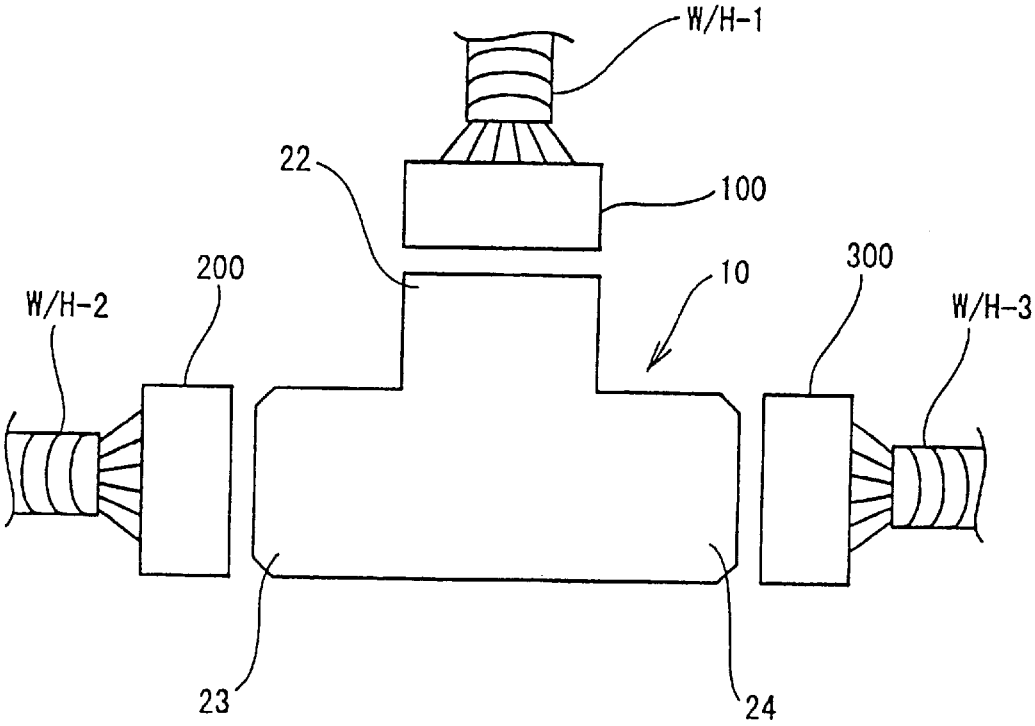
FIG. 2 is a schematic view showing the directions in which the joint connector of FIG. 1 and wire harnesses are connected to each other.

As seen in FIG. 2, the first connector socket 22 in use receives a connector 100 at the end of trunk electrical wiring W/H-1 of a wire harness. The second connector socket 23 receives a connector 200 at the end of first branch electrical wiring W/H-2 of the wire harness. The third connector socket 24 receives a connector 300 at the end of a second branch electrical wiring W/H-3 of the wire harness. The connectors 100, 200 and 300 have terminals (not shown) within them which engage and connect to the tabs at the end portions of the respective sets of bus bars 13 and 15.

The bus bars 13 in the Y-direction and the bus bars 15 in the X-direction are not cut at any points. Thus, the tabs 15*a* and 15*b* of each X-direction bus bar 15 are connected with the same wire of the trunk electric wiring W/H-1 of the wire harness through one Y-direction bus bar 13. That is to say, the same circuit connection is obtained regardless of whether the particular connector fits in the second or third connector sockets 23 and 24.

Figure 4A:
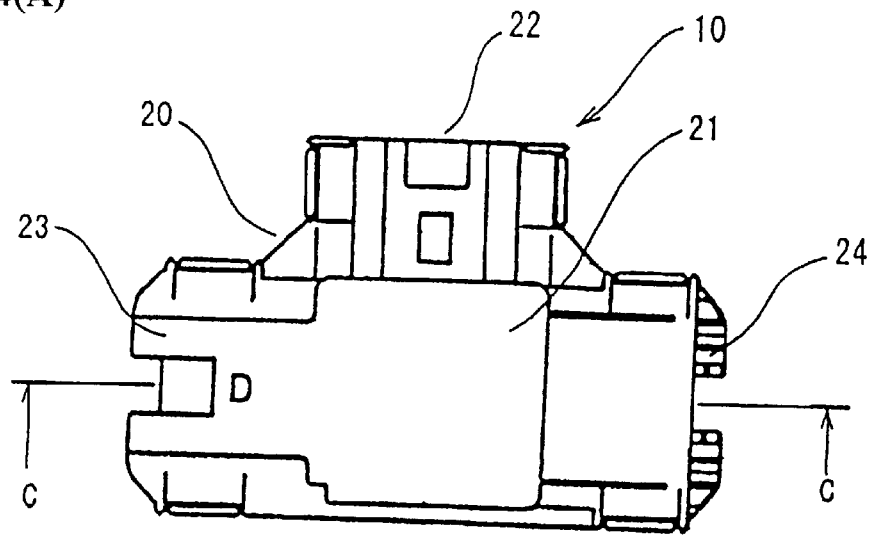
FIG. 4(A) is a plan view of the joint connector of FIG. 1.
Figure 4B:
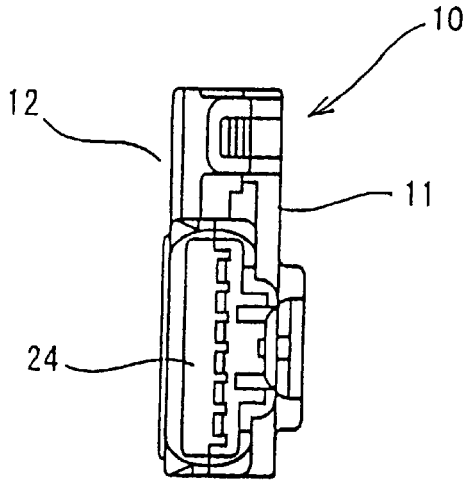
FIG. 4(B) is a side view of the joint connector of FIG. 1.
Figure 4C:
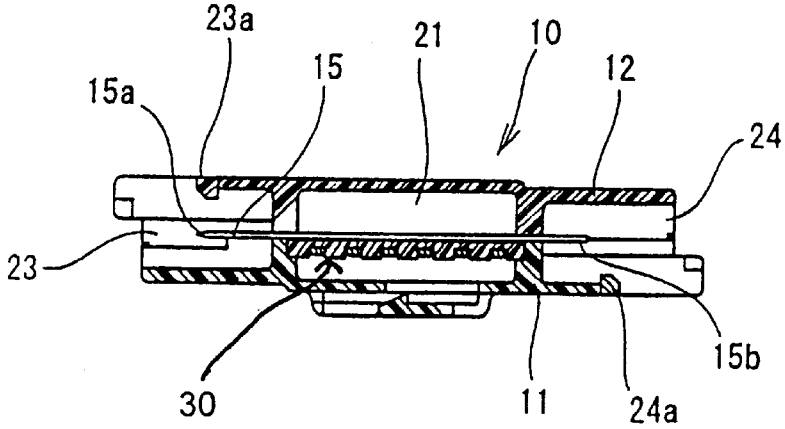
FIG. 4(C) is a sectional view taken along line C—C of FIG. 4(A)
Figure 5A:
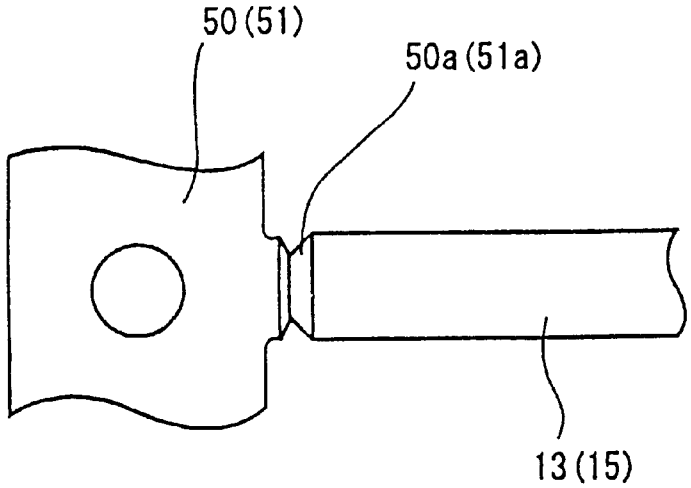
FIG. 5(A) is an enlarged plan view showing a connection between a bus bar and a carrier in the process of making the joint connector of FIG. 1.
Figure 5B:
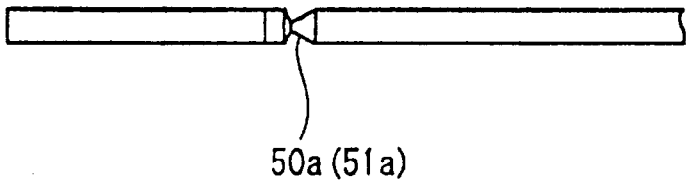
FIG. 5(B) is a front view of FIG. 5(A)

As shown in FIG. 4(C), the second connector socket 23 has the same configuration as that of the third connector socket 24 but the two are mutually inverted. A connector-locking claw 23*a* may be formed on the second connector socket 23 at its upper side. A connector-locking claw 24*a* is formed on the third connector socket 24 at its lower side.

The connectors 200 and 300 connected to the branch wirings W/H-2, W/H-3 respectively have the same configuration. The connectors 200 and 300 each have, on a corresponding surface, a locking groove (not shown) to which the claws 23*a* and 24*a* lock. The connector 100 which fits in the first connector socket 22 may have a configuration different from that of the connectors 200 and 300.

Figure 7A:
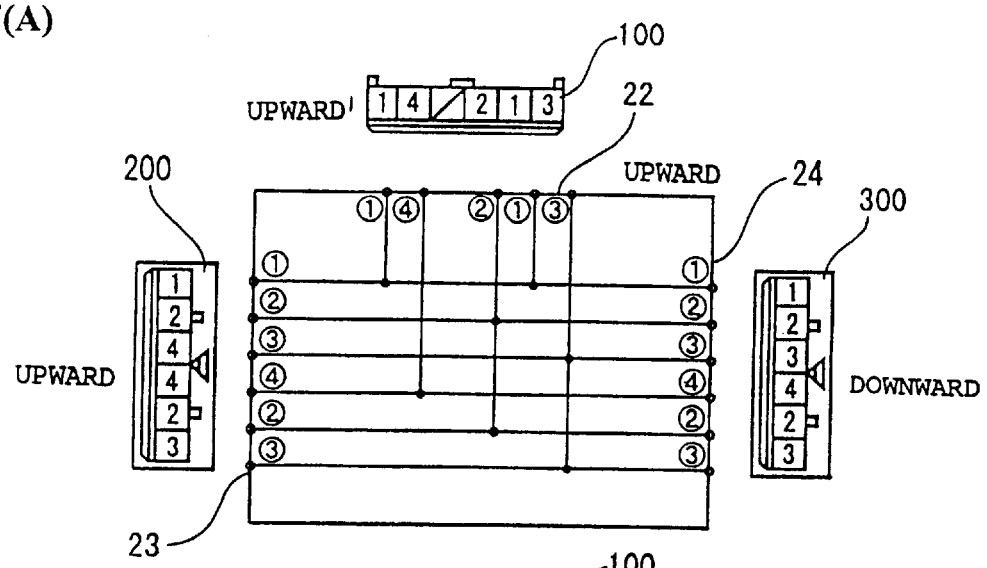
FIG. 7(A) is a diagram showing a normal connection state of the connector of FIG. 1.

Referring to FIG. 7(A), in the normal fitting state the connector 100 fits on the first connector socket 22 of the joint connector 10, the connector 200 (locking groove upward) fits on the second connector socket 23, and the connector 300 (locking groove downward) fits on the third connector socket 24.

Figure 7B:
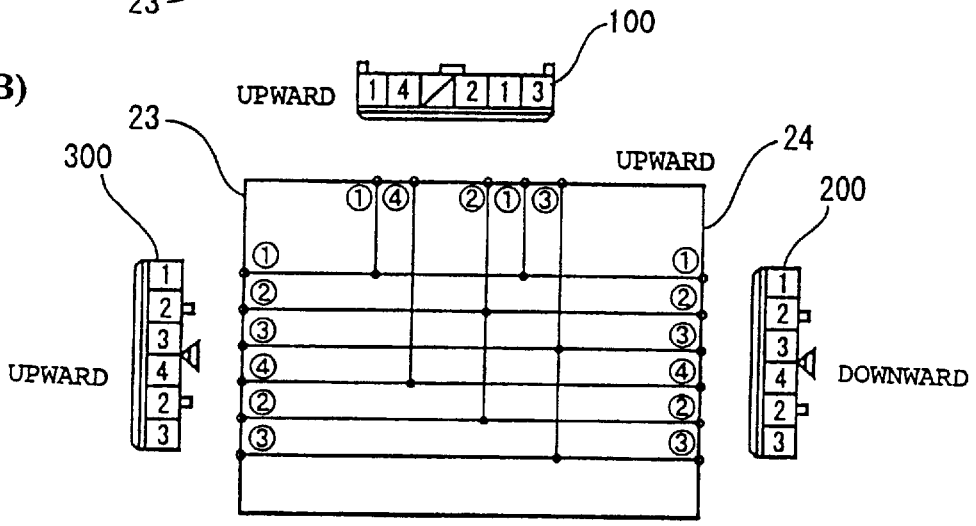
FIG. 7(B) is a diagram showing an erroneous connection state of the connector of FIG. 1.

Referring to FIG. 7(B), let it be supposed that the connector 300 is erroneously fitted on the second connector socket 23 and that the connector 200 fitted on the third connector socket 24. In this case, in order to lock the claw 23*a* of the second socket 23 and the claw 24*a* of the third socket 24 to the respective locking grooves of the connectors 200 and 300 each of the connectors 200 and 300 must be inverted. Consequently, the same circuit connections as in the normal circuit shown in FIG. 7(A) are obtained.

Figure 7C:
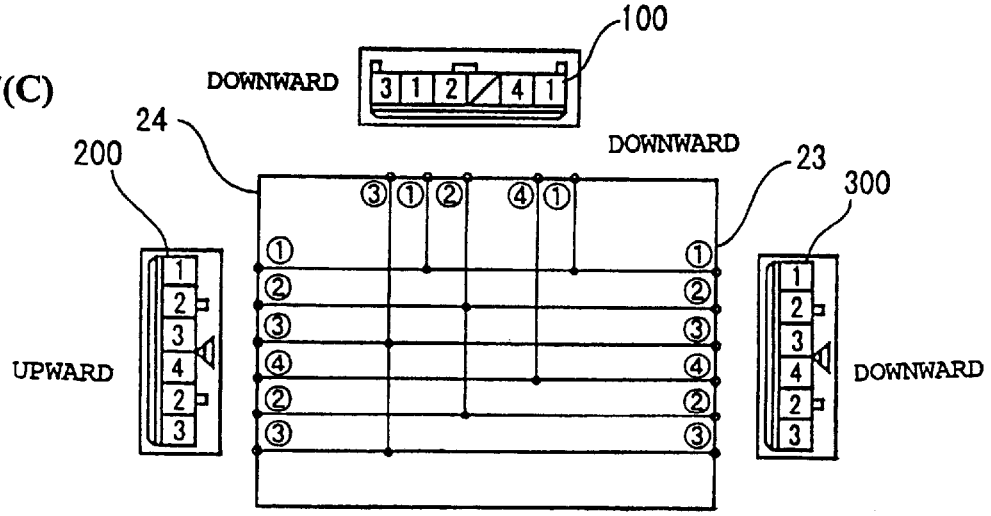
FIG. 7(C) is a diagram showing a connection state of the connector of FIG. 1 in the case where the connector is inverted.
Figure 8:
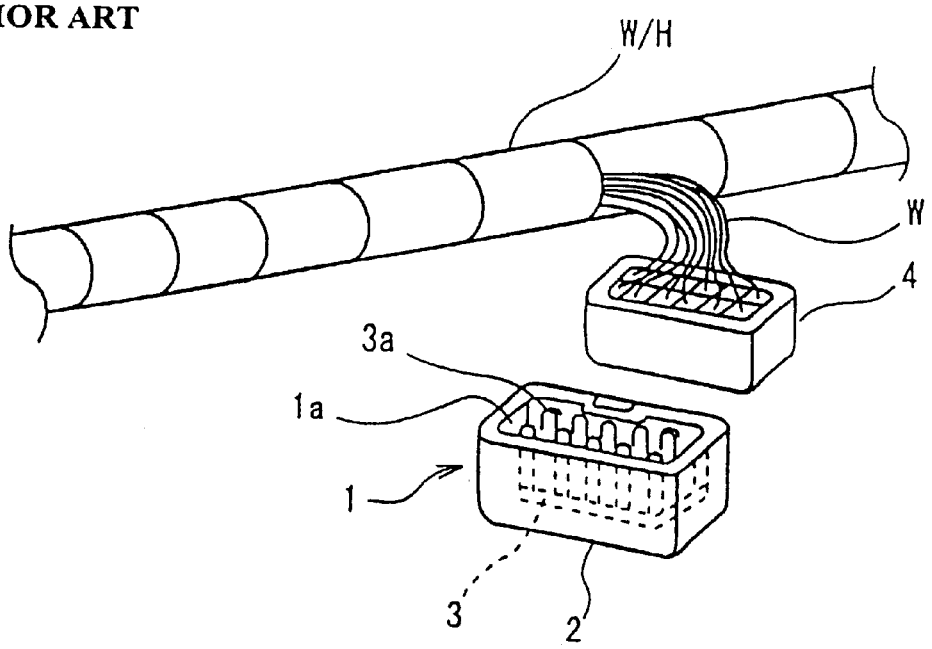
Fig. 8 PRIOR ART
FIG. 8 is a schematic perspective view showing a conventional joint connector.
Figure 9:
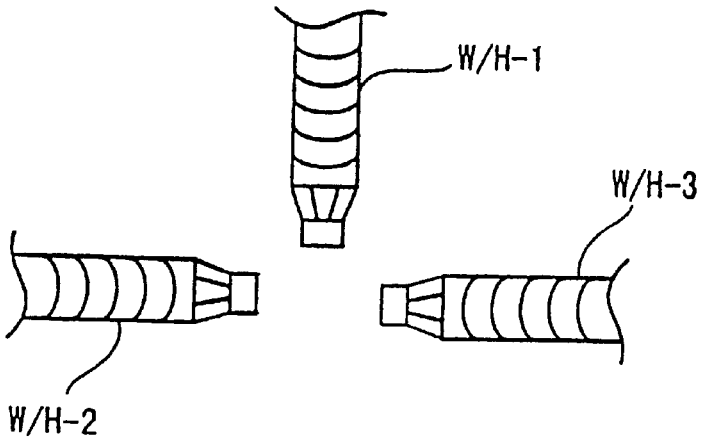
Fig. 9 PRIOR ART
FIG. 9 is a schematic view showing a problem with the conventional joint connector.

Referring to FIG. 7(C), let it be supposed that the joint connector 10 is inverted, so that the third socket 24 now occupies the position of the second socket 23, and the second socket 23 occupies the position of the third socket 24. As the circuit of the second socket 23 is the same as that of the third socket 24, the same connections are achieved. Therefore, the connectors 200 and 300 can be connected in the normal state.

To summarize, with the invention, even though a connector connected to a wire harness may be erroneously fitted on the joint connector, an erroneous circuit is not obtained. That is, the connector is normally connected to the joint connector. Further, because the connector socket of the joint connector can be set in different directions, it is possible to make an optimum division of the wire harness according to a wiring mode and set a branching position according to the space for installing the wire harness.

Further, because the internal circuit of the joint connector is a combination of elongate bus bars, it is possible to manufacture the bus bar assembly simply and inexpensively. In addition, the joint connector is thin. Thus, the joint connector fixed to the peripheral surface of the wire harness with a tape is not bulky, so that the wire harness can be wired on a vehicle body with a high wiring operability.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A joint connector for connection to first, second and third exterior electrical connectors to effect electrical connection between said first and second exterior connectors and between said first and third exterior connectors, comprising:

an insulation plate having first and second faces opposite to each other and a plurality of through holes extending from the first face to the second face;

a plurality of first elongate bus bars mounted on said first face and extending in parallel in a first direction and having first end portions constituting a set of first connection tabs;

a plurality of second elongate bus bars mounted on said second face and extending in parallel in a second direction crossing said first direction, whereby said first and second bus bars form a lattice array having intersection points of the bus bars, said second bus bars having second and third end portions, respectively at opposite ends thereof, the second end portions constituting a set of second connection tabs and the third end portions constituting a set of third connection tabs, said first and second bus bars being electrically joined to each other at a plurality of said intersection points through the through holes in said insulation plate to form a predetermined interior circuit in the joint connector; and a casing of flat shape accommodating said insulation plate and said first and second bus bars and having first, second and third connector-receiving locations adapted to receive said exterior connectors in use of the joint connector;

wherein said first connection tabs are located in said first connector-receiving location to connect in use to said first said exterior connector, and said sets of second and third connector tabs are located respectively in said second and third connector-receiving locations, which are on opposite sides of said casing, to connect in use respectively to said second and third exterior connectors; and said interior circuit is such that the circuit connections from said first connection tabs to said set of second connector tabs and from said first connection tabs to said set of third connector tabs are identical.

2. A joint connector according to claim 1, wherein said second and third connector-receiving locations have substantially identical shape and configuration but are mutually inverted with respect to said casing, said first connector-receiving location having a substantially different shape and configuration from said second and third connector receiving locations.

3. A joint connector according to claim 2, wherein each of said second and third connector-receiving locations has a locking claw that locks to an exterior connector received therein, said locking claws being in mutually inverted positions and orientations.

4. An assembly comprising:

first, second and third exterior electrical connectors; and a joint connector that effects electrical connection between said first and second exterior connectors and between said first and third exterior connectors;

said joint connector comprising:

an insulation plate having first and second faces opposite to each other and having a plurality of through holes extending from the first face to the second face;

a plurality of first elongate bus bars mounted on said first face and extending in parallel in a first direction and having first end portions constituting a set of first connection tabs, a plurality of second elongate bus bars mounted on said second face and extending in parallel in a second direction crossing said first direction, whereby said first and second bus bars form a lattice array having intersection points of the bus bars, said second bus bars having second and third end portions, respectively at opposite ends thereof, the second end portions constituting a set of second connection tabs and the third end portions constituting a set of third connection tabs, said first and second bus bars being electrically joined to each other at a plurality of said intersection points through the through holes in said insulation plate to form a predetermined interior circuit in the joint connector; and a casing of flat shape accommodating said insulation board and said first and second bus bars and having first, second and third connector-receiving locations adapted to receive said exterior connectors to make electrical connection therewith;

wherein said first connection tabs are located in said first connector-receiving location to connect to said first exterior connector when received therein, and said sets of second and third connector tabs are located respectively in said second and third connector-receiving locations, which are on opposite sides of said casing, to connect to respectively said second and third exterior connectors when received therein;

said interior circuit is such that the circuit connections from said first connection tabs to said set of second connector tabs and from said first connection tabs to said set of third connector tabs are identical; and said second and third exterior connectors are substantially identical and are adapted to be received interchangeably in said second and third connector-receiving locations.

5. An assembly according to claim 4, wherein said second and third connector-receiving locations have substantially identical shape and configuration but are mutually inverted with respect to said casing, said first connector-receiving location having a substantially different shape and configuration from said second and third connector-receiving locations.

6. An assembly according to claim 4, wherein said first, second and third exterior connectors are each connected to wiring of a wire harness.

* * * * *